United States Patent [19]

Nitta

[11] Patent Number: 4,884,964

[45] Date of Patent: Dec. 5, 1989

[54] FILE ASSEMBLY FOR USE IN A GAS LIGHTER

[75] Inventor: Tomio Nitta, Yokohama, Japan

[73] Assignee: Tokai Corporation, Yokohama, Japan

[21] Appl. No.: 284,623

[22] Filed: Dec. 15, 1988

[30] Foreign Application Priority Data

Dec. 28, 1987 [JP] Japan ..... 62-197396[U]

[51] Int. Cl.[4] ..... F23Q 1/02

[52] U.S. Cl. ..... 431/277; 431/273

[58] Field of Search ..... 431/277, 276, 273, 267

[56] References Cited

U.S. PATENT DOCUMENTS 3,966,392 6/1976 Lockwood ..... 431/277 X

FOREIGN PATENT DOCUMENTS 126574 1/1948 Australia ..... 431/277

7500229 7/1976 France ..... 431/277

*Primary Examiner*—Randall L. Green

*Attorney, Agent, or Firm*—Armstrong, Nikaido, Marmelstein, Kubovcik & Murray

[57] ABSTRACT

Disclosed is a file assembly which is adapted to be fitted in and integrally connected to the top of a gas lighter housing, comprising a rotatable file disk and a file block having two opposite support plates each having a semicircular-and-wide-and-narrow slot made on its inside, leaving its outside for ornamental space. Necessary bearings for the flint wheel can be formed by inserting narrow-and-wide rectangular pieces in the semicircular-and-narrow-and-wide slots of the opposite support plates, leaving the semicircular-and-narrow rectangular spaces enough to snugly accommodate the opposite ends of the axle of the flint wheel, thereby eliminating the necessity of making very small pivot holes exactly at selected places in selected parts of the lighter, and hence reducing the manufacturing cost by as much as would cost if such very small holes were made exactly at selected places in selected parts of the lighter.

2 Claims, 4 Drawing Sheets

FILE ASSEMBLY FOR USE IN A GAS LIGHTER

BACKGROUND OF THE INVENTION

1. Field of the Invention

The present invention relates to a selected part of a gas lighter, particularly to a file assembly which is designed to be fitted in and integrally connected to the top of a gas lighter housing.

2. Related Arts

In general, a gas lighter has a housing open at its top, and a ceiling plate fitted on the open top of the housing. The ceiling plate has a fire-striking unit and a wind shield encircling a part of the fire-striking unit, which includes a file wheel, a gas ejection nozzle, an ignition lever etc. As for the file wheel it is rotatably journaled in the holes made in opposite support plates, which stand upright on the top of a gas lighter housing. A flint is pushed against the file wheel by a spring.

Making a pair of holes in the opposite support plates for journaling a file wheel requires an advanced technology because of its very small size, and this prevents mass production of file assemblies and reduction of manufacturing cost. Also, disadvantageously holes in the opposite support plates make the appearance of gas lighter less pleasing, and the opposite support plates cannot be used as a part of ornament because of the holes made therein.

SUMMARY OF THE INVENTION

One object of the present invention is to provide a file assembly for a gas lighter, which assembly makes it unnecessary to make holes in the file-wheel support plates, accordingly improving the manufacturing efficiency and reducing the manufacturing cost of gas lighters.

Another object of the present invention is to provide a file assembly for a gas lighter, which assembly makes it possible to use the hole-free surfaces of the file-wheel support plates as a part of ornament.

To attain these objects of the present invention a file assembly which is adapted to be fitted in and integrally connected to the top of a gas lighter housing, is improved according to the present invention in that it comprises: a rotatable file disk having an axle; and a file block having two opposite support plates each having a slot made on its inside, leaving its hole-free outside for ornamental space, each slot being wide enough to permit insertion of each corresponding file-support projection of the top of the gas lighter housing, and being enough to leave a space for snugly accomodating each end of the axle of the file disk after inserting each corresponding file-support projection in each slot.

With this arrangement the file wheel can be rotatably journaled by the hole-free support plates.

Other objects and advantages of the present invention will be understood from the following description of a preferred embodiment of the present invention, which is shown in the accompanying drawings:

PREFERRED EMBODIMENT OF THE INVENTION

Figure 1:
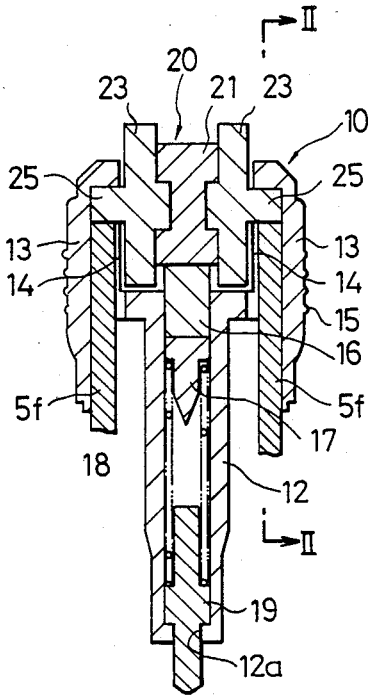
FIG. 1 is a longitudinal section of a file assembly according to the preferred embodiment of the present invention.
Figure 2:
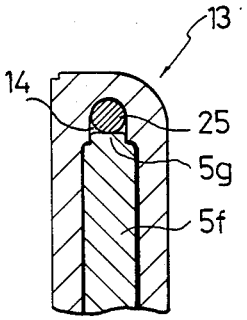
FIG. 2 is a longitudinal section taken along the line II—II of FIG. 1.
Figure 3:
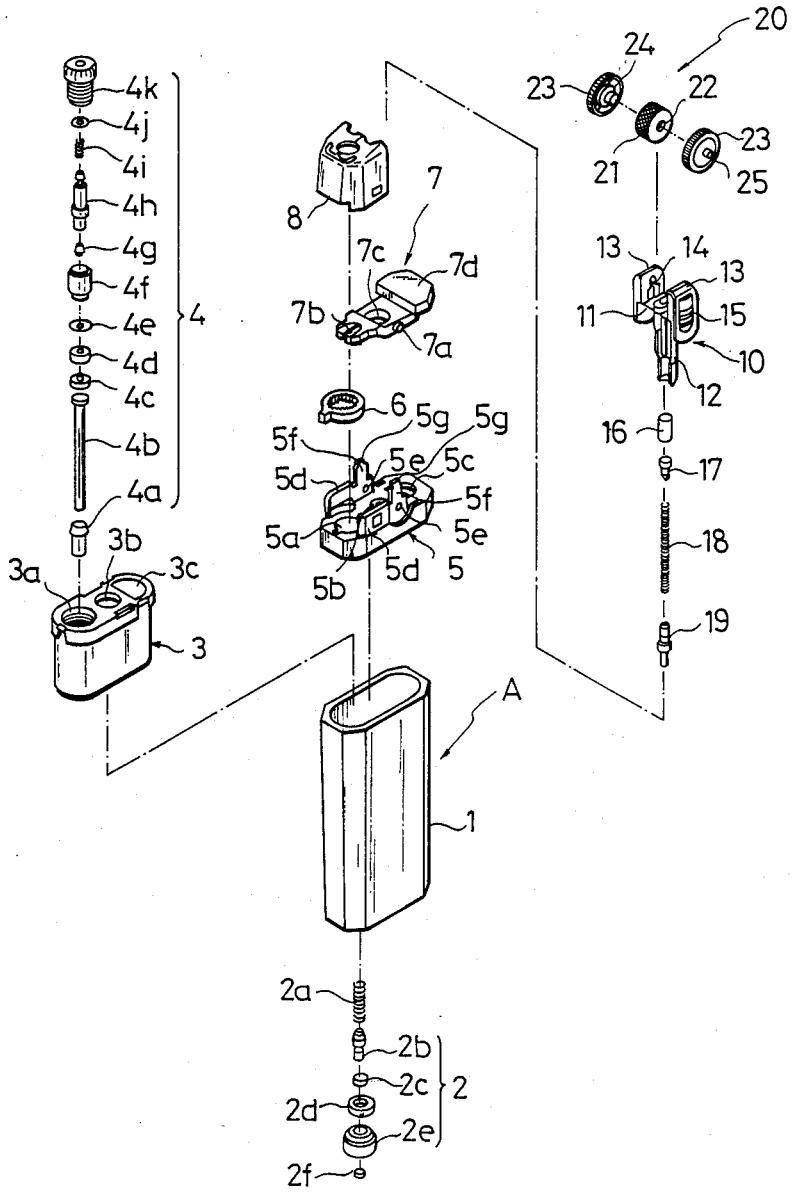
FIG. 3 is an exploded view of a gas lighter having a file assembly built in according to the preferred embodiment of the present invention.

FIG. 1 is a longitudinal section of a file assembly according to the preferred embodiment of the present invention showing a file disk journaled in a yoke block, and FIG. 2 is a longitudinal section taken along the line II—II of FIG. 1. FIG. 3 is an exploded view of a gas lighter having the file assembly built in. As shown in FIG. 3, the gas lighter "A" has a gas housing 1. It constitutes a gas well, and has a gas injection valve 2 built in its bottom. The gas injection valve 2 is composed of a spring 2*a*, a gas injection tube 2*b*, a valve seat rubber 2*c*, a control ring 2*d*, a gas injection closure 2*e*, and another valve seat rubber 2*f*.

As shown, in FIG. 3, the lighter housing 1 has a top closure 3 fitted in its opening. The top closure 3 has a gas well plug 4 threadedly engaged with a threaded hole 3*a* at its one end. The gas well plug 4 is composed of a tube holder 4*a*, a tube 4*b*, a nail-like fastner 4*c*, an aperture filter 4*d*, an O-ring 4*e*, a nozzle bottom piece 4*f*, a valve rubber 4*g*, a gas ejection nozzle 4*h*, a nozzle spring 4*i*, an O-ring screw 4*j* and a nozzle screw 4*k*. The top closure has another hole 3*b* to snugly accomodate a file assembly (later described) at its center, and a depression 3*c* to permit the descent of the free end of a thumb-operating lever (later described) at the other end, which end is opposite to the end at which the gas well plug 4 is fitted in.

Figure 4:
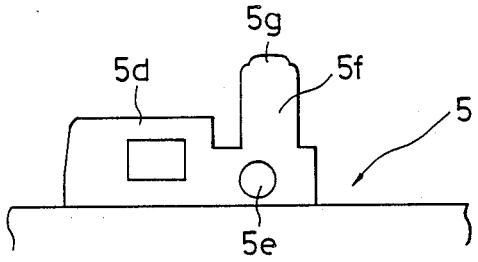
FIG. 4 is a side view of the ceiling plate with a mount integrally connected thereto.

An intervenient block 5 is fixed to the top closure 3, which is fitted in the gas lighter housing 1. As shown, in FIG. 3, the intervenient block 5 has a nozzle hole 5*a* at its one end through which the nozzle screw 4*k* is inserted. A file assembly hole 5*b* is formed at the center of the block to fit the file assembly in. And a depression hole 5*c* is formed at the other end of the block. A thumb-operated lever 7 when pushed down, will incline about its pivot, permitting its free end to fall in the depression hole 5*c* of the intervenient block 5. The head of the nozzle screw 4*k* in the threaded hole 3*a* projects throughout the hole 5*a*, and a flame-adjusting ring 6 is fitted on the circumference of the head. The flame length can be controlled by rotating the flame-adjusting ring 6. As shown in FIG. 3, the intervenient block 5 has two support pieces 5*d* integrally connected to its opposite sides. A wind-shield 8 is fixed to the front end of the intervenient block 5. Each support piece 5*d* has a journal hole 5*e* at its rear end. The thumb-operated lever 7 has a pinch end 7*b* to hold the gas ejection nozzle 4*h* of the gas well plug 4. Also, the lever 7 has a center hole 7*c* for accomodating the file assembly 10 and a raised plateau 7*d* for putting the thumb thereon. The thumb-operated lever 7 is rotatably attached to the intervenient block 5 by inserting its pivots 7a to the journal holes 5*e* of the opposite support pieces 5*d*. As shown in FIG. 4, each support piece 5*d* has a support extention 5*f* integrally connected to and standing upright from the place at which the journal hole 5*e* is made. The support extension 5*f* has a bearing plateau 5*g* on its top.

Figure 5:
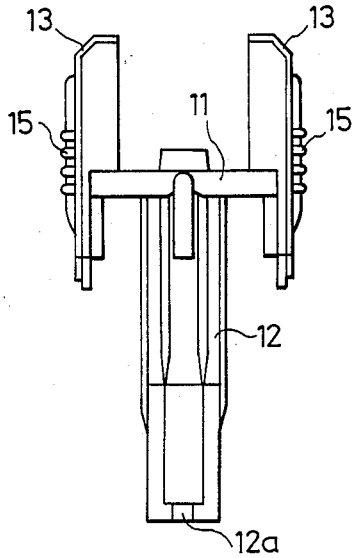
FIG. 5 is a front view of the file assembly according to the preferred embodiment of the present invention.
Figure 6:
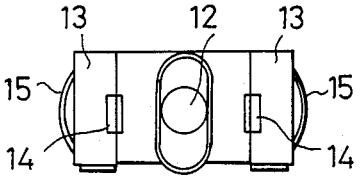
FIG. 6 is a plan view thereof.
Figure 7:
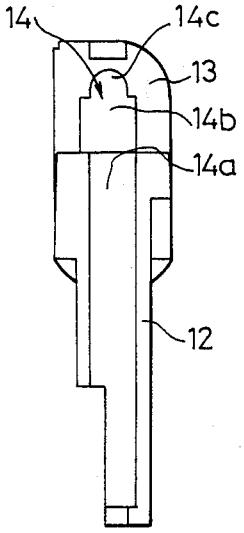
FIG. 7 is a central longitudinal section thereof.
Figure 8:
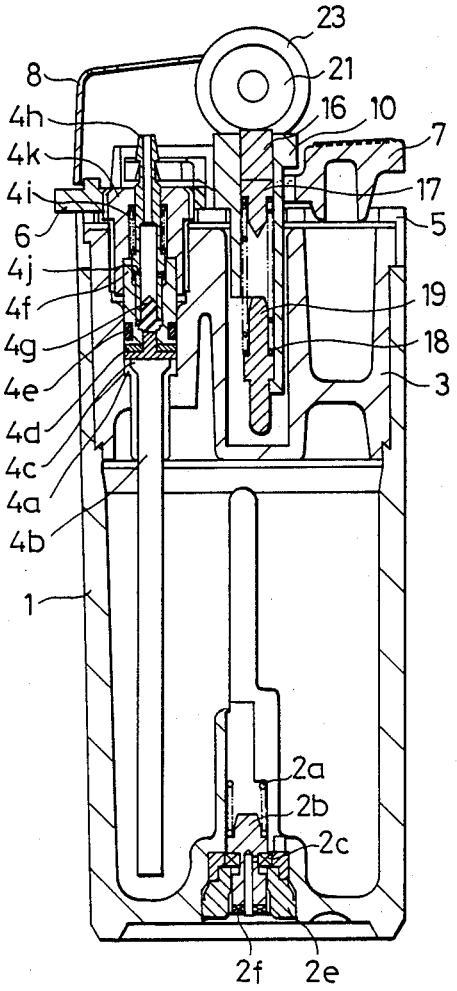
FIG. 8 is a longitudinal section of a gas lighter having a file assembly built in according to the preferred embodiment of the present invention.
Figure 9:
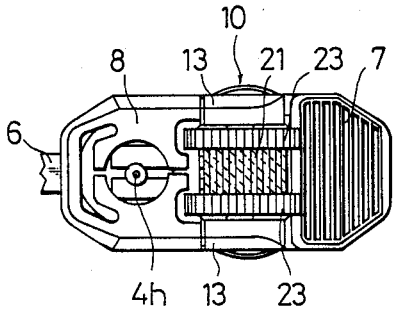
FIG. 9 is a plane view of the gas lighter.

As shown in FIGS. 5 to 7, a file assembly 10 which is to be assembled in the gas lighter housing A, comprises a lateral support 11, a flint container cylinder 12 integrally connected to the lateral support 11, and two vertical supports 13 integrally connected to the opposite ends of the lateral support 11. The flint container cylinder 12 has a cylindrical space along its upper half length, a semi-cylindrical space along its lower half length and a semi-circular hole 12*a* on its bottom. Each vertical support 13 has a semicircular-and-wide-and-narrow rectangular slot 14 made on its inside, leaving its outside for ornamental space. The wide part 14*a* of each slot 14 is wide enough to permit insertion of the support extension 5*f* of the support piece 5*d*, and the narrow part 14b of the slot 14 is wide enough to permit insertion of the bearing plateau 5g of the support piece 5*d*, thus leaving the semicircular-and-rectangular space 14c for snugly accomodating each end of the axle of a file disk, which is later described in detail. Each vertical support 13 has an ornamental relief 15 on its outer surface.

As shown in FIG. 3, a flint 16, a push pin 17, a spring 18 and a stop screw 19 are inserted in the flint container cylinder 12 in the order named. A file wheel 20 is designed to be attached to the support piece 5*d* of the intervenient block 5 by inserting its axle in the semicircular-and-rectangular bearing space 14c of the support pieces 13. The file wheel 20 is composed of a file disk 21 having a blind hole 22 made on each side, and a pair of wheels 23 each having inner and outer projections 24, 25. The file disk 21 and the wheels 23 are integrally combined with the inner projections 24 of the wheels 23 inserted into the blind holes 22 of the file disk 21. The outer projections 25 of the wheels 23 are used as the axle of the flint wheel 20 thus built up.

In assembling, the flint container cylinder 12 of the flint assembly 10 is inserted first in the hole 7*c* of the thumboperated lever 7, then in the hole 5*b* of the intervenient block 5, and finally in the hole 3*b* of the top closure 3. Then, the support extension 5*f* of each support piece 5*d* is inserted in the wide and narrow parts 14*a* and 14*b* of the slot 14, which is made in the inside of each vertical support 13. Also, the opposite ends of the axle 25 of the flint wheel 20 are inserted in the semicircular-and-rectangular bearing spaces which remain in the slots 14 inside the vertical supports 13, resting on the bearing plateaus 5g of the support extensions 5*f*. Thus, the flint wheel 20 is rotatably supported, and then the flint wheel is not allowed to slip off from the support extensions 5*f* of the support pieces 5*d*. Then, the flint 15 is pushed against the flint disk 21 by the spring 18 in the flint container cylinder 12.

In use, the flint wheel 20 is rotated to strike fire, and at the same time the thumb-operated lever 7 is pushed down to lower and open the gas ejection nozzle 4h and permit the ejection of gas from the gas well.

As seen from the above, necessary bearings for a flint wheel can be formed according to the present invention by inserting narrow-and-wide rectangular pieces in the semicircular-and-narrow-and-wide rectangular slots made on the inside surfaces of opposite support pieces, leaving the semicircular-and narrow rectangular spaces enough to snugly accomodate the opposite ends of the axle of the flint wheel, thereby eliminating the necessity of making very small pivot holes exactly at selected places in selected parts of the lighter, and hence reducing the manufacturing cost by as much as would cost if such very small holes were made exactly at selected places in selected parts of the lighter. Still advantageously, the outside surface of each support piece is free from the journal hole for bearing the file wheel, thus providing a smooth flat surface which can be used for ornamental purpose.

What is claimed is:

1. A file assembly which is adapted to be fitted in and integrally connected to the top of a gas lighter housing having file support projections, characterized in that it comprises: a rotatable file disk having an axle; and a file block having two opposite support plates each having a slot made on its inside surface, leaving its outside surface for ornamental space, each slot being wide enough to permit insertion of a corresponding file-support projection of the top of the gas lighter housing and being long enough to leave a space for snugly accomodating each end of the axle of the file disk after inserting each corresponding file-support projection in each slot.

2. A file assembly claimed in claim 1 wherein said slot is a semicircular-and-narrow-and-wide rectangular opening and said file-support projection is a narrow-and-wide rectangular piece rising from the top of the gas lighter housing, thus leaving a simicircular-and-rectangular space for bearing the axle of the file disk.

* * * * *